US009448025B2

(12) United States Patent
Farr et al.

(10) Patent No.: US 9,448,025 B2
(45) Date of Patent: Sep. 20, 2016

(54) FIREARM TRIGGER BLOCK AND TAMPER NOTIFICATION SYSTEM

(71) Applicants: Franklin Lynnwood Farr, Lake Havasu City, AZ (US); Virgil A. Venditto, Lake Havasu City, AZ (US)

(72) Inventors: Franklin Lynnwood Farr, Lake Havasu City, AZ (US); Virgil A. Venditto, Lake Havasu City, AZ (US)

(73) Assignee: Advanced Warning Systems, LLC, Lake Havasu, AZ (US)

( * ) Notice: Subject to any disclaimer, the term of this patent is extended or adjusted under 35 U.S.C. 154(b) by 0 days.

(21) Appl. No.: 14/838,357

(22) Filed: Aug. 27, 2015

(65) Prior Publication Data

US 2016/0061547 A1 Mar. 3, 2016

Related U.S. Application Data

(60) Provisional application No. 62/044,068, filed on Aug. 29, 2014.

(51) Int. Cl.
*F41A 17/54* (2006.01)

(52) U.S. Cl.
CPC ..... *F41A 17/54* (2013.01)

(58) Field of Classification Search
CPC ..... F41A 17/06; F41A 17/46; F41A 17/48; F41A 17/54
USPC ..... 42/70.06
See application file for complete search history.

(56) References Cited

U.S. PATENT DOCUMENTS

| | | | | |
|---|---|---|---|---|
| 5,283,971 | A * | 2/1994 | Fuller | F41A 17/54 42/70.06 |
| 5,437,119 | A * | 8/1995 | Womack | F41A 17/54 42/70.07 |
| 5,450,684 | A * | 9/1995 | Harris | F41A 17/54 42/70.07 |
| 5,487,234 | A * | 1/1996 | Dragon | F41A 17/54 340/571 |
| 5,561,935 | A | 10/1996 | McCarthy | |
| 5,704,152 | A | 1/1998 | Harrison | |
| 5,755,054 | A * | 5/1998 | Tuller | F41A 17/54 42/70.07 |
| 5,832,647 | A * | 11/1998 | Ling | F41A 17/54 42/70.07 |
| 5,899,102 | A * | 5/1999 | Ling | E05B 37/025 42/70.06 |
| 5,918,492 | A * | 7/1999 | Klebes | F41A 17/54 42/70.07 |
| 6,276,086 | B1 * | 8/2001 | Keaton | F41A 17/54 42/70.07 |
| 6,351,906 | B1 * | 3/2002 | Honig, Jr. | F41A 17/063 42/66 |

(Continued)

*Primary Examiner* — Joshua Freeman
(74) *Attorney, Agent, or Firm* — The Luther Law Firm, PLLC; Barbara J. Luther

(57) ABSTRACT

A trigger block and tamper notification system for use on a firearm includes a main enclosure assembly with an engagement element receivable through a trigger guard and a slide assembly having a complemental element releasably engaging the engagement element on an opposing side of the trigger guard. A magnetic reed switch is carried within the engagement element and a switch magnet is mounted in the slide assembly adjacent the complemental element so as to be in a position adjacent the magnetic reed switch when the slide assembly is engaged with the main enclosure assembly. A control module includes a signaling element activated when the switch magnet is moved from the position adjacent the reed switch.

5 Claims, 10 Drawing Sheets

Fig. 4

(56) References Cited

U.S. PATENT DOCUMENTS

| | | | | |
|---|---|---|---|---|
| 6,412,207 | B1 * | 7/2002 | Crye | F41A 17/02 42/70.01 |
| 6,601,332 | B1 | 8/2003 | Riebling | |
| 6,889,460 | B1 | 5/2005 | Brauer | |
| 7,216,449 | B2 * | 5/2007 | Riebling | F41A 17/54 42/70.06 |
| 7,430,826 | B2 | 10/2008 | Riebling | |
| 7,584,566 | B2 * | 9/2009 | Victor | F41A 17/02 42/70.06 |
| 8,683,727 | B2 | 4/2014 | McLean, III | |
| 8,819,979 | B2 | 9/2014 | Kelly | |
| 8,893,420 | B2 | 11/2014 | Milde, Jr. | |
| 8,919,024 | B2 | 12/2014 | Milde, Jr. | |
| 9,097,479 | B1 | 8/2015 | Barido | |
| 2002/0171249 | A1 * | 11/2002 | Daoud | E05C 19/06 292/202 |
| 2005/0229654 | A1 * | 10/2005 | Victor | E05B 73/00 70/58 |
| 2006/0112605 | A1 * | 6/2006 | Sopko | F41A 17/54 42/70.11 |
| 2006/0117633 | A1 * | 6/2006 | Chang | F41A 17/02 42/70.07 |
| 2007/0017137 | A1 * | 1/2007 | Farchione | F41A 17/54 42/70.08 |
| 2009/0072546 | A1 * | 3/2009 | Nguyen | F41A 17/54 292/6 |
| 2010/0218567 | A1 | 9/2010 | Victor | |
| 2011/0309975 | A1 | 12/2011 | Chu | |
| 2012/0137559 | A1 * | 6/2012 | Burns, III | F41A 17/54 42/70.06 |
| 2013/0061502 | A1 * | 3/2013 | Derman | F41A 17/54 42/70.07 |
| 2013/0312306 | A1 * | 11/2013 | Ruffin | F41A 17/066 42/70.07 |
| 2013/0318847 | A1 * | 12/2013 | Kelly | F41A 17/46 42/70.06 |
| 2014/0202058 | A1 * | 7/2014 | Zhou | F41A 17/063 42/70.11 |
| 2014/0317980 | A1 * | 10/2014 | Michel | F41A 3/66 42/6 |
| 2015/0033609 | A1 * | 2/2015 | Herdman | F41A 23/18 42/70.07 |
| 2015/0198402 | A1 * | 7/2015 | Brace | F41A 17/54 42/70.06 |

* cited by examiner

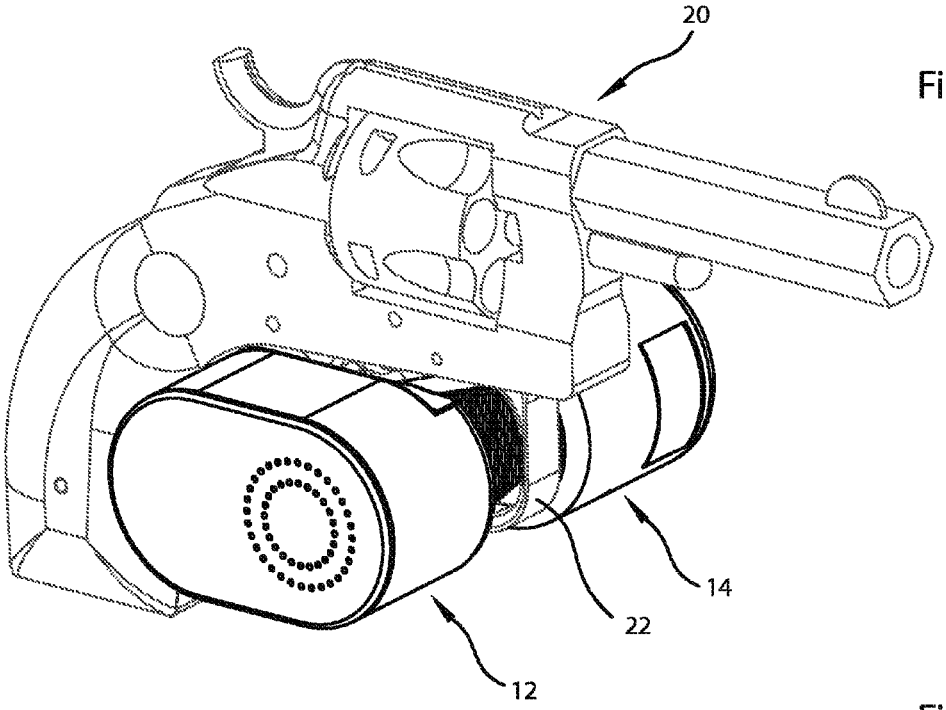
Fig. 2
Fig. 3
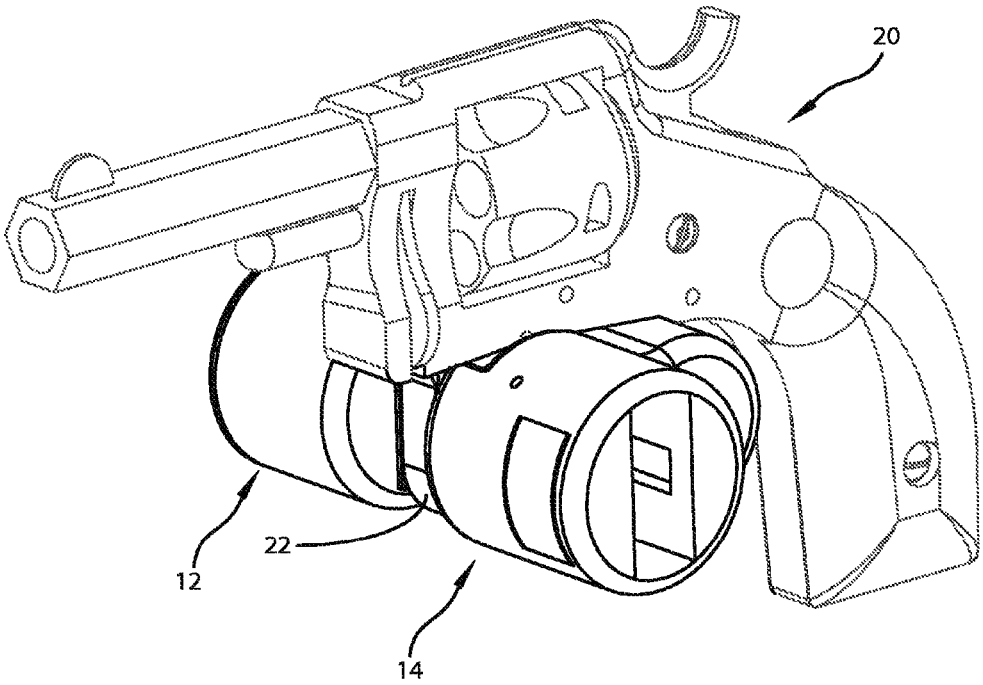

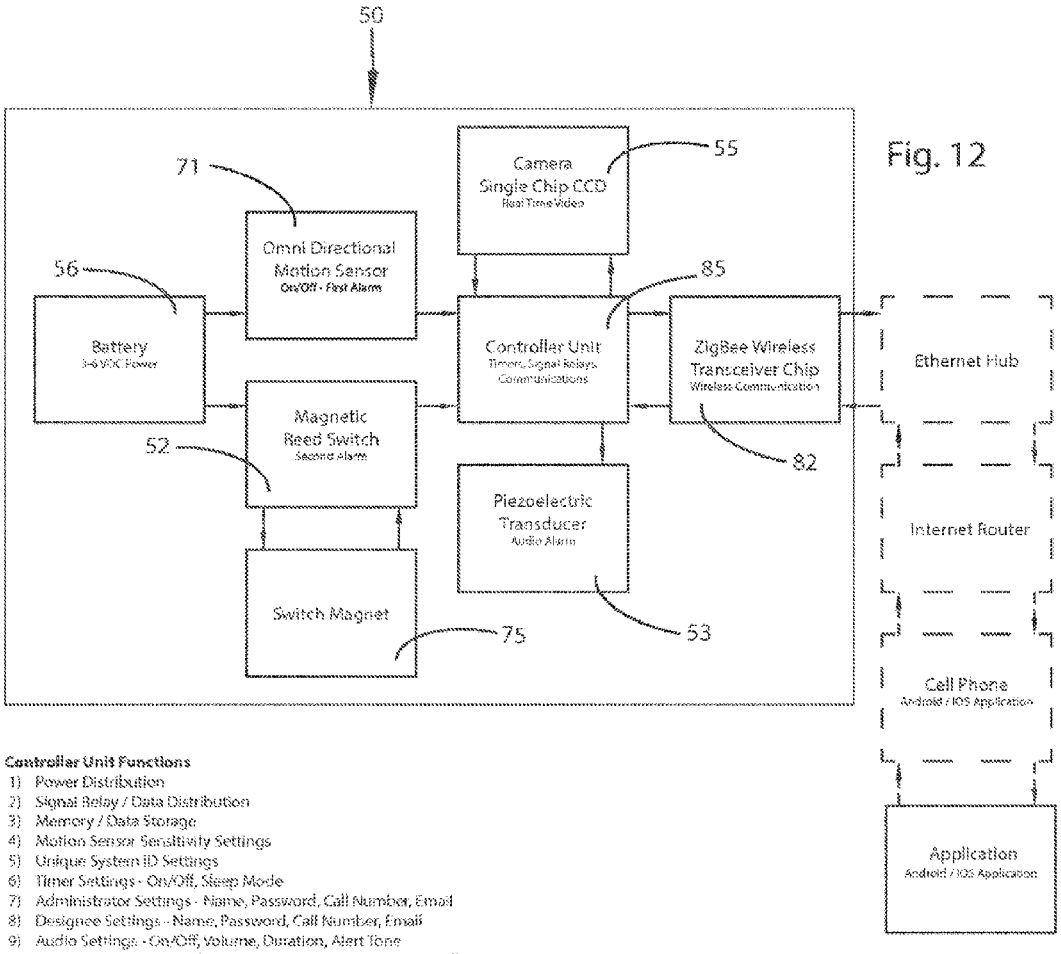

Fig. 12

Controller Unit Functions

1) Power Distribution
2) Signal Relay / Data Distribution
3) Memory / Data Storage
4) Motion Sensor Sensitivity Settings
5) Unique System ID Settings
6) Timer Settings - On/Off, Sleep Mode
7) Administrator Settings - Name, Password, Call Number, Email
8) Designee Settings - Name, Password, Call Number, Email
9) Audio Settings - On/Off, Volume, Duration, Alert Tone
10) Video Settings - On/Off, Sensitivity, Duration, Capture On/Off
11) Reset

Cell Phone Application Functions / Remote Programing

1) Motion Sensor Sensitivity Settings
2) Unique System ID Settings
3) Timer Settings - On/Off, Sleep Mode, Day/Night
4) Administrator Settings - Name, Password, Call Number, Email
5) Designee Settings - Name, Password, Call Number, Email
6) Audio Settings - On/Off, Volume, Duration, Alert Tone
7) Video Settings - On/Off, Sensitivity, Duration, Capture On/Off
8) Status Settings - Not Loaded, Loaded, Bullet in Chamber
9) Reset

FIREARM TRIGGER BLOCK AND TAMPER NOTIFICATION SYSTEM

CROSS-REFERENCE TO RELATED APPLICATION

This application claims the benefit of U.S. Provisional Patent Application No. 62/044,068, filed 29 Aug. 2014.

FIELD OF THE INVENTION

This invention relates to firearm safety devices.

More particularly, the present invention relates to firearm trigger blocks.

BACKGROUND OF THE INVENTION

In the field of firearm safety, devices for preventing accidental discharge of firearms are numerous and somewhat effective. Often, these devices employ locking mechanisms which prevent the trigger from being moved, thus, preventing firing. While highly effective in preventing discharge of the firearm, they prevent quick access when a firearm is needed quickly, such as in home defense situations or the like. Trigger locks require a key or combination which may be unavailable, forgotten or not readily accessible during emergency situations. Additionally, these devices provide no indication of ongoing theft of or tampering with the firearm.

Often, firearms used for defense are stored loaded, and in an easily accessible location. This is so that the firearm can be used quickly. While trigger locks provide safety from accidental firing, they reduce the effectiveness of the firearm by increasing the delay before use. Additionally, if a child finds the firearm, while it is generally safe, the owner has no idea it has been tampered with and possibly moved. Firearm thefts are also prevalent, and are not deterred by trigger locks. Once stolen, the lock can be removed at leisure. In these instances, nothing indicates movement of the firearm from its proper location, and one cannot determine who tampered with or took the firearm.

It would be highly advantageous, therefore, to remedy the foregoing and other deficiencies inherent in the prior art.

An object of the present invention is to provide a trigger block to help prevent accidental firing of a firearm, while maintaining the ability to remove the block quickly and easily.

Another object of the present invention is to provide a trigger block which will indicate to the owner when the gun is disturbed.

Yet another object of the present invention is to capture the image of the individual disturbing the firearm.

SUMMARY OF THE INVENTION

Briefly, to achieve the desired objects and advantages of the instant invention, provided is a trigger block and tamper notification system for use on a firearm, including a main enclosure assembly and a slide assembly. The main enclosure assembly includes an engagement element receivable through a trigger guard of a firearm from a first side. A slide assembly has a complemental element for releasably engaging the engagement element on an opposing side of the trigger guard. A magnetic reed switch is carried within the engagement element. A switch magnet is mounted in the slide assembly adjacent the complemental element so as to be in a position adjacent the magnetic reed switch when the slide assembly is engaged with the main enclosure assembly. A control module has a signaling element which is activated when the switch magnet is moved from the position adjacent the reed switch.

The trigger block and tamper notification system can also include a motion sensor carried by the main enclosure assembly and coupled to the control module. The motion sensor will initiate a signal from the control module when the firearm is moved. The signal element is controlled by the control module to emit at least one of an audio signal, a visual signal, a wireless signal to a wireless device, and a signal to activate a camera carried by the main enclosure assembly upon activation of the motion sensor or switching of the reed switch.

The trigger block and tamper notification system can also include an adjustable blocking cam extending from the main enclosure assembly and receivable through the trigger guard of the firearm from the first side and for receipt by the slide assembly on the opposing side. The blocking cam includes a post extending from a base to a distal end which is receivable within a socket formed in the slide assembly. The base is rotatably carried by the main enclosure assembly with the post extending outwardly therefrom, parallel to the engagement element. A pair of flanges extends longitudinally along the post from the base to a position spaced apart from the distal end, and outwardly from opposing sides of the post.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings in which:

FIG. 2 is a left side isometric view of the trigger block of FIG. 1, installed on a firearm;

FIG. 3 is a right side isometric view of the trigger block of FIG. 1, installed on a firearm;

FIG. 12 is a simplified block diagram of the tamper notification system of the trigger block.

DETAILED DESCRIPTION OF A PREFERRED EMBODIMENT

Figure 1:
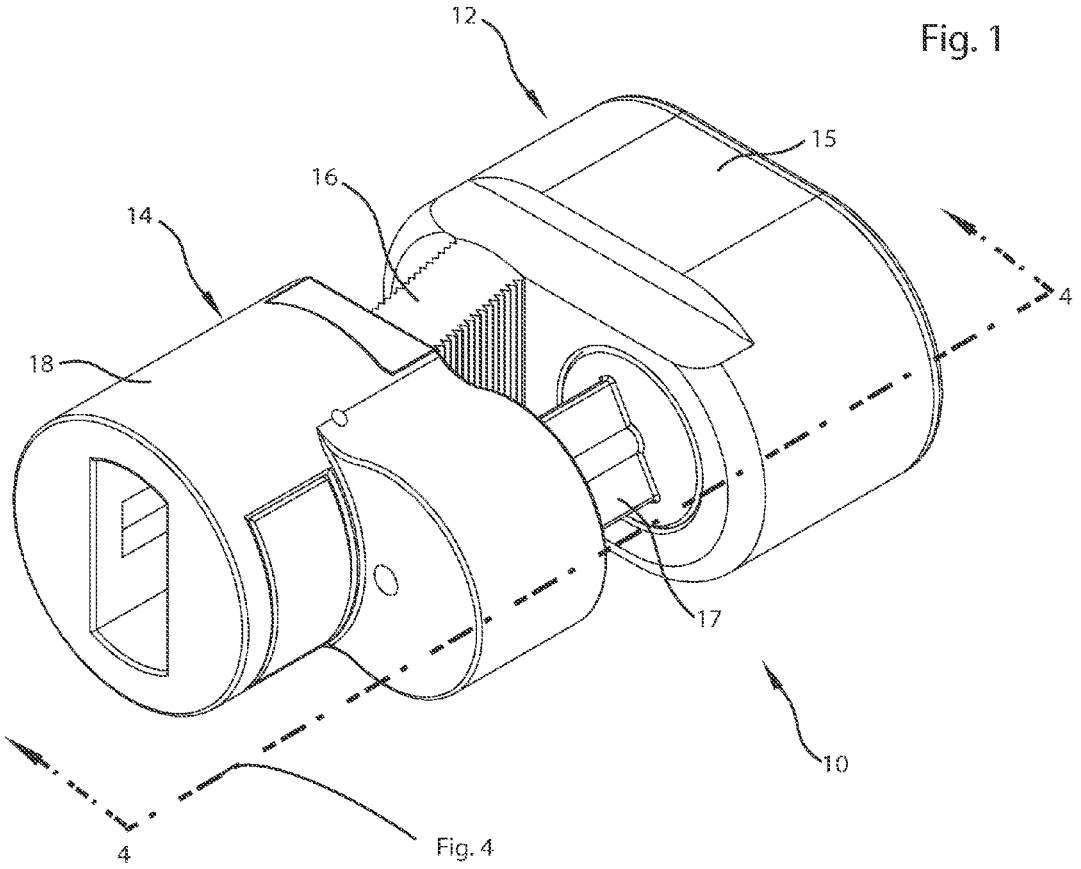
FIG. 1 is an isometric view of the trigger block according to the present invention.

Turning now to the drawings in which like reference characters indicate corresponding elements throughout the several views, attention is directed to FIG. 1 which illustrates a firearm trigger block generally designated 10. Trigger block 10 includes a main enclosure assembly 12 and a slide assembly 14. Main enclosure assembly 12 includes a housing 15 carrying an engagement member, which in this embodiment is a tapered probe element 16, and an adjustable blocking cam 17, each extending therefrom. Slide assembly 14 includes a housing 18 defining sockets acting as complemental elements for receiving tapered probe element 16 and adjustable blocking cam 17, which will be described presently.

Figure 7:
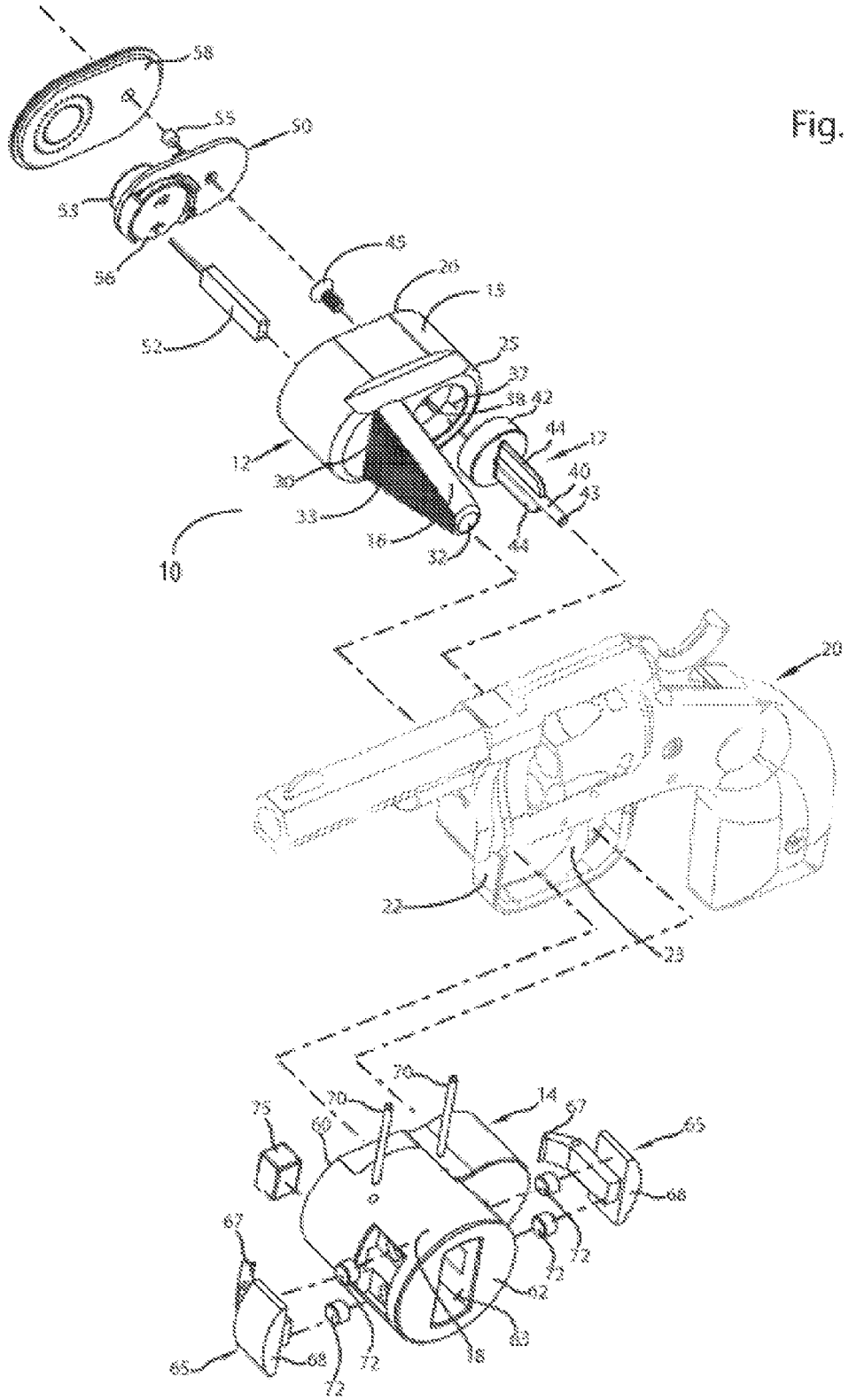
FIG. 7 is an exploded view of the trigger block of FIG. 1 with a firearm.

With additional reference to FIGS. 2, 3 and 7, trigger block 10 is illustrated in an installed position (FIGS. 2 and 3) and is fitted on a firearm 20 to prevent unauthorized use of firearm 20. Main enclosure assembly 12 is positioned on one side of firearm 20 at trigger guard 22, with tapered probe element 16 passing through trigger guard 22 from one side, forward of a trigger 23 (FIG. 7) and adjustable blocking cam 17 extending through trigger guard 22 from the same side as probe element 16, rearward of trigger 23 (FIG. 7). Slide assembly 14 is positioned on the opposing side of the firearm and receives probe element 16 and blocking cam 17. In this manner, firearm 20 is rendered inoperative until trigger block 10 is removed by an authorized user. As will be described presently, firearm block 10 also includes a tamper notification system which is activated if and when the firearm is moved and/or the trigger block is removed.

Figure 4:
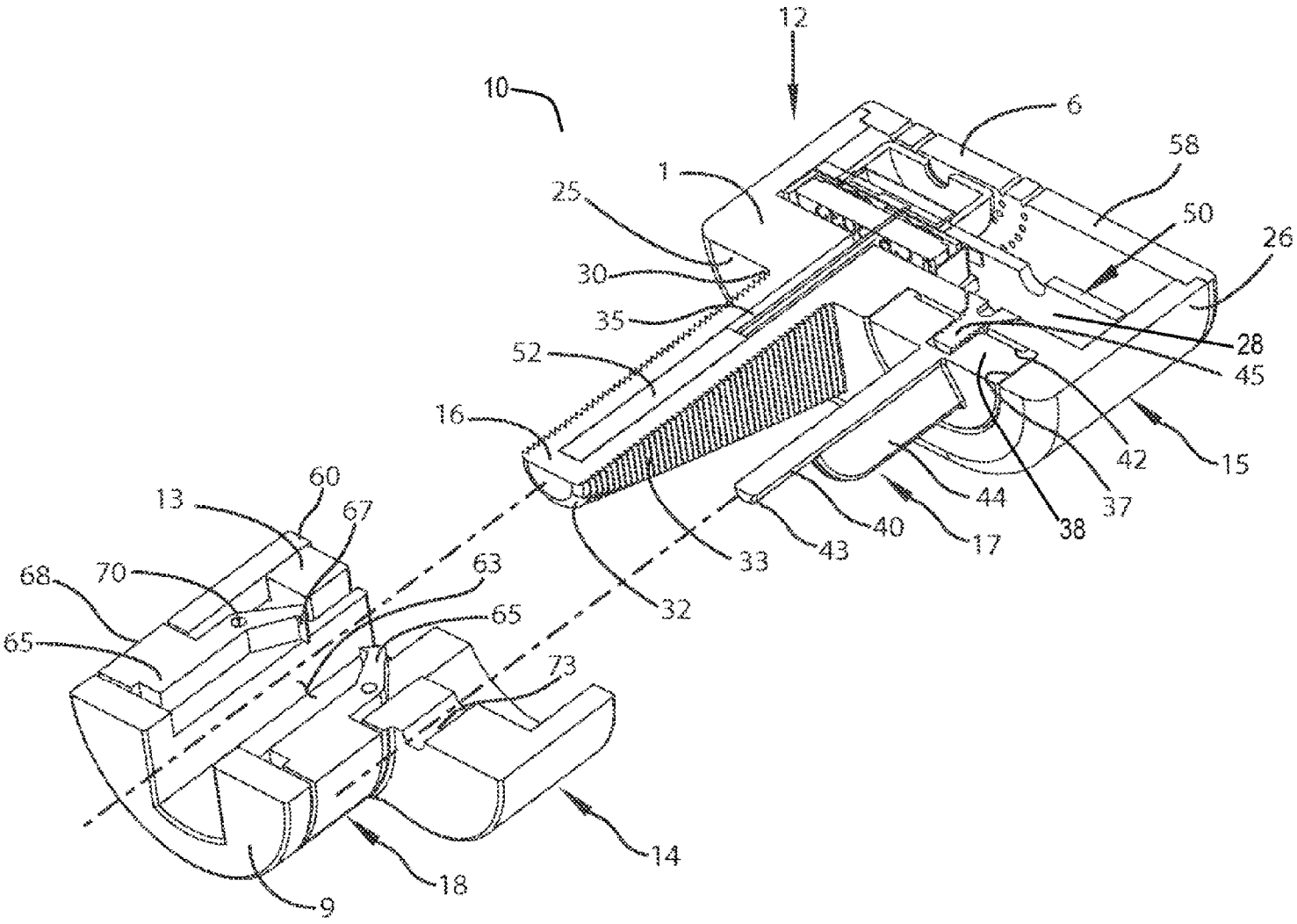
FIG. 4 is an isometric sectional view of the trigger block of FIG. 1 taken along line 4-4.

Referring now to FIG. 4, trigger block 10 is illustrated in a sectional view taken along lines 4-4 of FIG. 1. With additional reference to FIG. 5, main enclosure assembly 12 includes housing 15 having an inner end 25, an outer end 26, and defining an interior volume 28. Tapered probe element 16 extends outwardly from inner end 25, in an inwardly directed orientation with respect to trigger block 10. For purposes of orientation, the terms "inner", "inward" and "inwardly directed" are intended to refer to a position or direction toward the firearm trigger guard with trigger block 10 in the installed position. The terms "outer", "outward" and "outwardly directed" are intended to refer to a position or direction away from the firearm trigger guard with trigger block 10 in the installed position. Tapered probe element 16 is tapered from a proximal end 30 proximate inner end 25, to a distal end 32, and flattened on opposing side to accommodate the formation of a plurality of parallel teeth 33 angled outwardly with respect to trigger block 10, toward housing 15. Parallel teeth 33 are formed on the opposed flattened outer surfaces of tapered probe element 16, extending transverse to the longitudinal axis of tapered probe element 16. In this preferred embodiment, tapered probe element 16 defines an interior volume 35 in physical communication with interior volume 28 of housing 15 for purposes which will be described presently.

Inner end 25 of housing 15 further defines a socket 37 formed therein and positioned adjacent to tapered probe element 16. Socket 37 has a central aperture 38 formed therein, in physical communication with interior volume 28 of housing 15. Adjustable blocking cam 17 includes a central post 40 extending from a base 42 to a distal end 43. Base 42 is generally cylindrical in shape, and is rotatably received in socket 37, with post 40 extending outwardly from inner housing end 25, in an inwardly directed orientation with respect to trigger block 10, and parallel to tapered probe element 16. Each of a pair of flanges 44 extend longitudinally along post 40, from base 42 to a position spaced apart from distal end 43, and outwardly from opposing sides of post 40. A fastening element couples base 42 within socket 37 and can be adjusted for rotational movement and static positioning of base 42. In this embodiment, the fastening element is a screw 45 extending from interior volume 28, through aperture 38 into base 42. By tightening screw 45, base 42, and therefore adjustable blocking cam 17, is held in a static position. When screw 45 is loosened, base 42, and therefore adjustable blocking cam 17, is free to rotate for purposes which will be described presently. Since adjustable blocking cam 17 extends through trigger guard 22 rearward of trigger 23 in the installed position, accommodation has been made to permit removal of adjustable blocking cam 17 in those instances where there is no space behind the trigger. In those instances, screw 45 is completely removed, and base 42 is removed from socket 37.

When properly adjusted, the interaction of adjustable blocking cam 17 with the front of the trigger guard and the engagement element through the trigger guard prevent movement of trigger block 10 and prevent discharge of the firearm.

Figure 5:
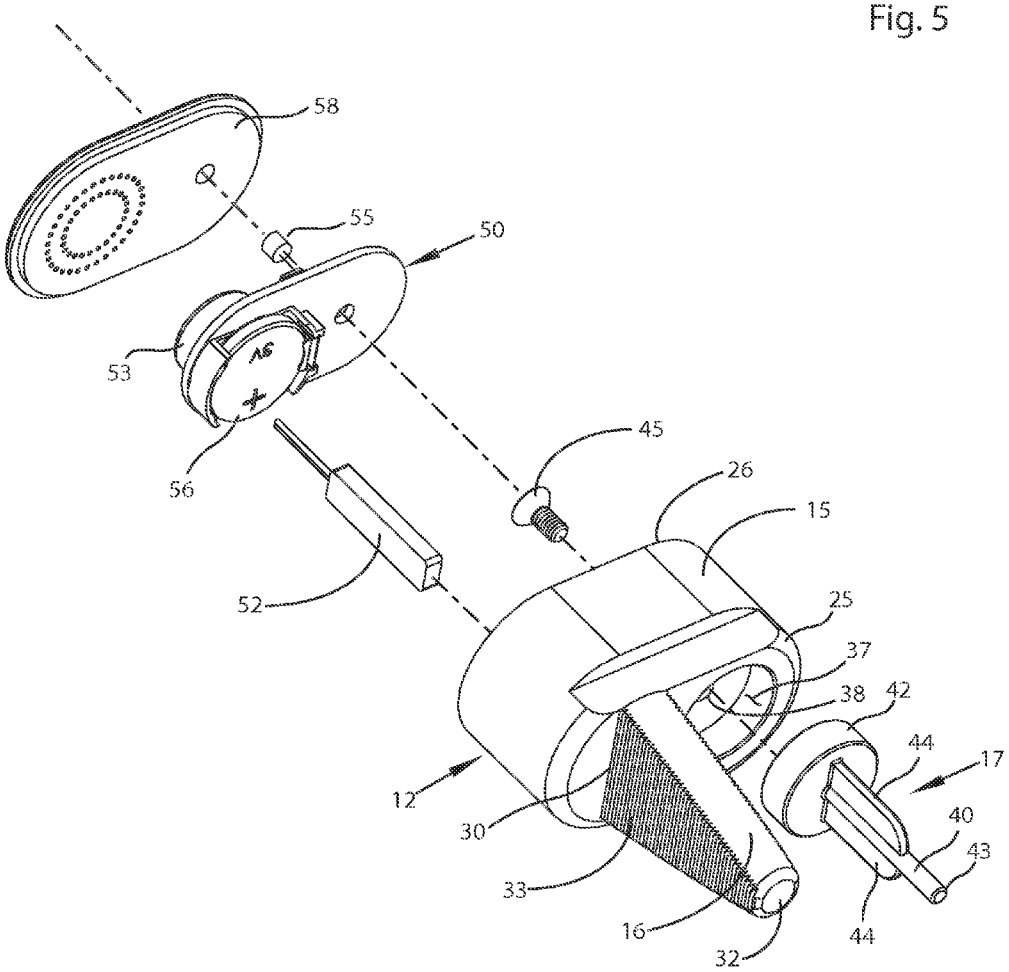
FIG. 5 is an exploded isometric view of the main enclosure assembly.

Still referring to FIGS. 4 and 5, main enclosure assembly 12 further includes a control module 50 carried by housing 15 within volume 28. In the preferred embodiment, control module 50 is a printed circuit board supporting the various components used in the tamper notification system of the present invention. A magnetic reed switch 52 is carried within interior volume 35 of tapered probe element 16, and is electrically coupled to control module 50. Magnetic reed switch 52 is movable between an open and a closed configuration by an adjacent switch magnet as will be disclosed presently. A reed switch can be normally open and moved to the closed position by a magnet, or normally closed, and moved to the open position by an adjacent magnetic field. Control module 50 further includes a signaling 53 element, which in this instance is a device for emitting an audio signal. One skilled in the art will understand that visual signals, such as flashing lights can also be employed or wireless signal to a remote device such as a cell phone and the like. A camera 55, a power source 56, such as a battery, and wireless transmitting elements are also carried by control module 50, and will be described in more detail presently. A cover 58 closes outer end 26 of housing 15, and includes apertures for egress of audio or visual signals, and an aperture to accommodate camera 55.

Figure 6:
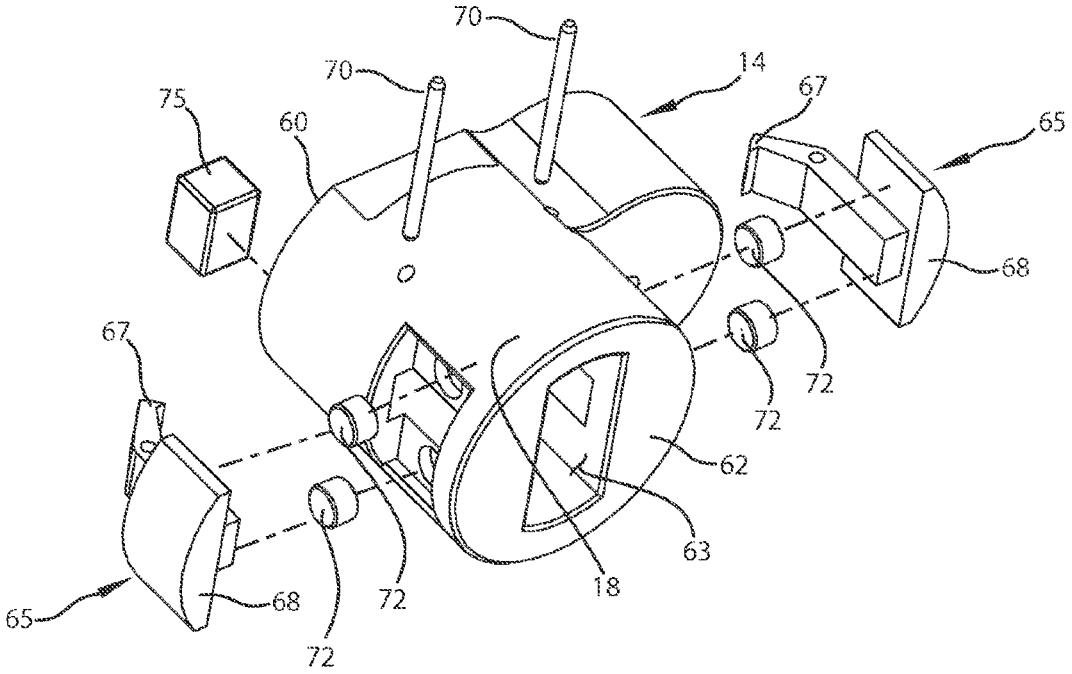
FIG. 6 is an exploded view of the slide assembly.
Figure 8:
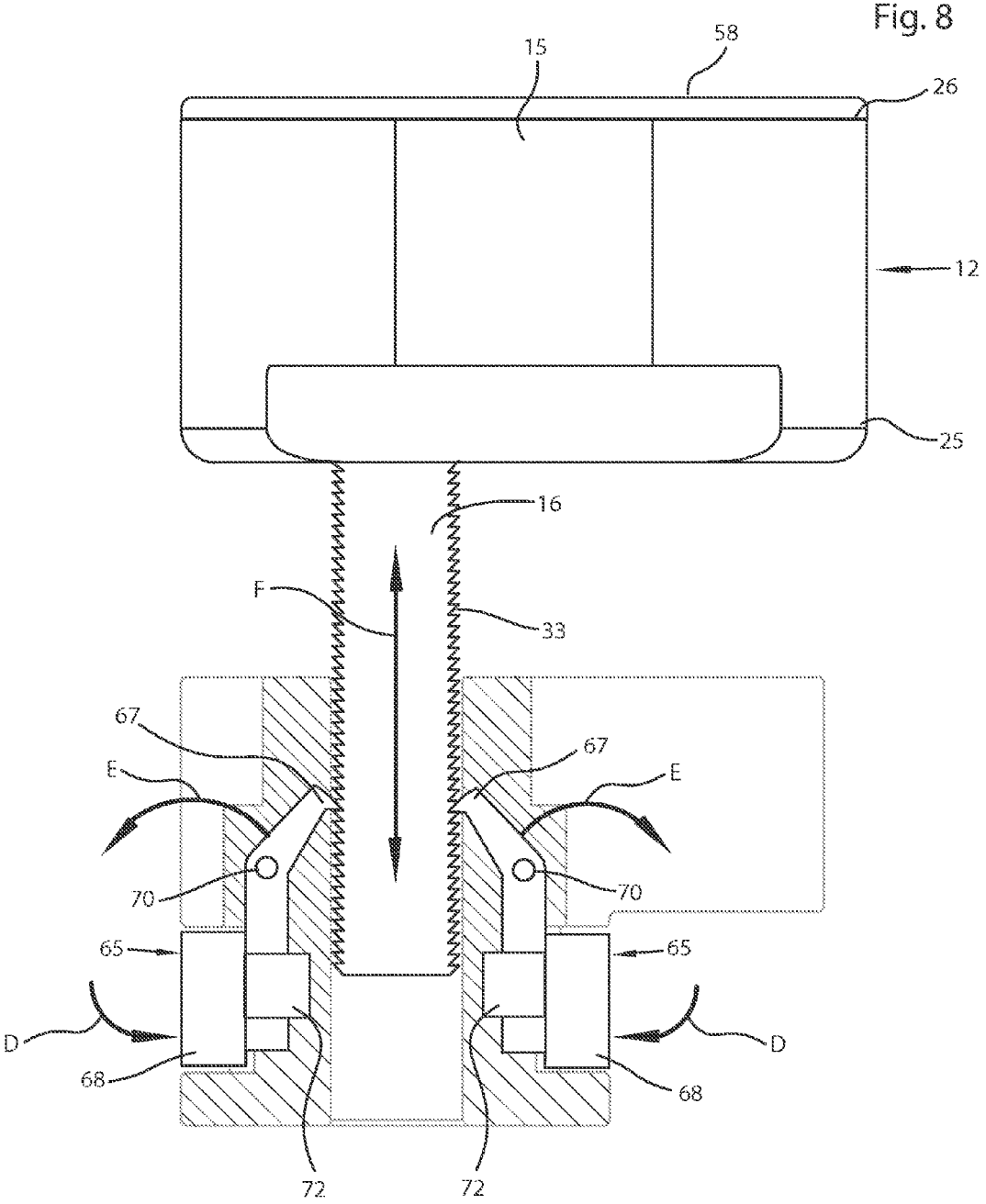
FIG. 8 is a top view of the trigger block of FIG. 1 with a cut-away view of the slide assembly.

Still referring to FIG. 4, with additional reference to FIGS. 6, and 8, slide assembly 14 includes housing 18 having an inner end 60, an outer end 62, and defining a central channel 63 extending through housing 18 from inner end 60 to outer end 62. Channel 63 and a pair of pawl elements 65 form the complemental element in the present invention. The pair of pawl elements 65 is mounted in housing 18, each element of the pair being mounted on opposing sides of channel 63 and each includes a latch end 67 and a release end 68. Pawl elements 65 are each mounted on a pivot pin 70 and include intermediate latch end 67 and release end 68 for pivotal movement between an engage position and a release position. Biasing elements 72 bias pawl elements 65 into the engage position, in which latch end 67 extends radially into channel 63. Biasing elements 72 are elastomeric compression pads mounted between an inset portion of housing 18 and release end 68. Pawl elements 65 are moved to the release position by compressing release ends 68 inwardly in the direction of arrowed lines D (FIG. 8), toward channel 63 and against the bias of biasing elements 72. This movement results in latch ends 67 pivoting radially outwardly in the direction of arrowed lines E (FIG. 8), out of channel 63. It will be understood that other biasing elements, such as compression springs, tension springs, torsion springs and the like, can be employed. A switch magnet 75 is mounted in housing 18 adjacent channel 63 so as to be positioned adjacent magnetic reed switch 52 when slide assembly 14 is engaged with main enclosure assembly 12. Housing 18 additionally includes a receiving socket 78 for receiving the distal end 43 of adjustable blocking cam 17.

Figure 9:
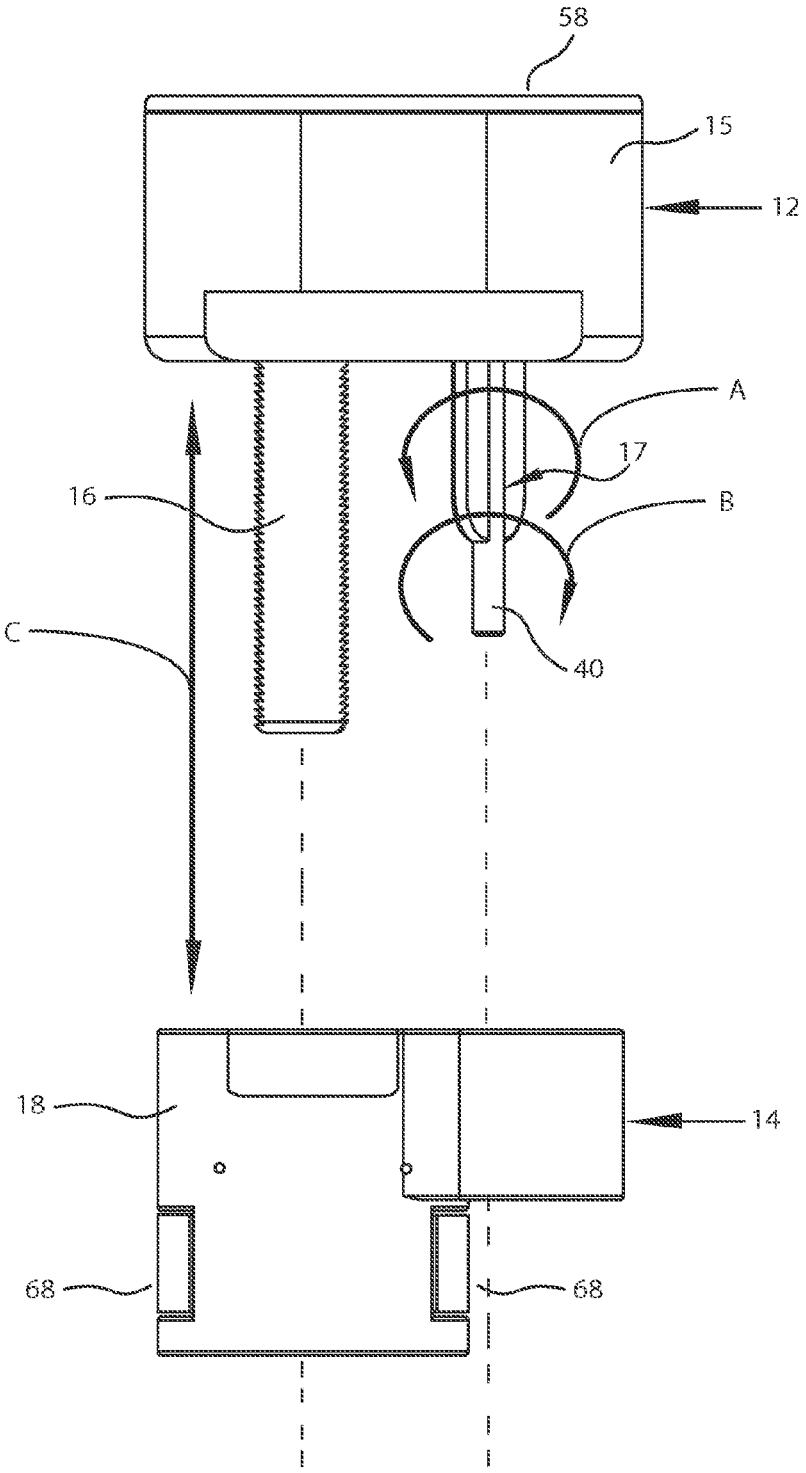
FIG. 9 is a top view of the trigger block of FIG. 1, illustrating linear and radial motion.

Still referring to FIG. 4, with additional reference to FIGS. 8 and 9, main enclosure assembly 12 and slide assembly 14 are coupled together by inserting tapered probe element 16 into channel 63 from inner end 60 and distal end 43 of adjustable blocking cam 17 into receiving socket 73 as indicated by arrowed line C (FIG. 9). Main enclosure assembly 12 is fixedly coupled to slide assembly 14 by latch ends 67 of pawl elements 65 engaging teeth 33, preventing withdrawal thereof. Tapered probe element 16 can be forcibly inserted into channel 63, overcoming the bias of bias elements 72. The angle of teeth 33 and the bias prevents withdrawal of tapered probe element 16 therefrom. Removal of tapered probe element 16 is accomplished by depressing release ends 68, thereby moving pawl elements 65 from the engage position to the release position. This movement removes latch ends 67 from engagement with teeth 33. This can be accomplished by compressing opposing release ends by the thumb and forefinger of one hand. The space between can be sufficient to prevent children from easily releasing the device. Additionally, the bias can be sufficient to prevent young children from being able to move the pawl elements to the release position.

Figure 10:
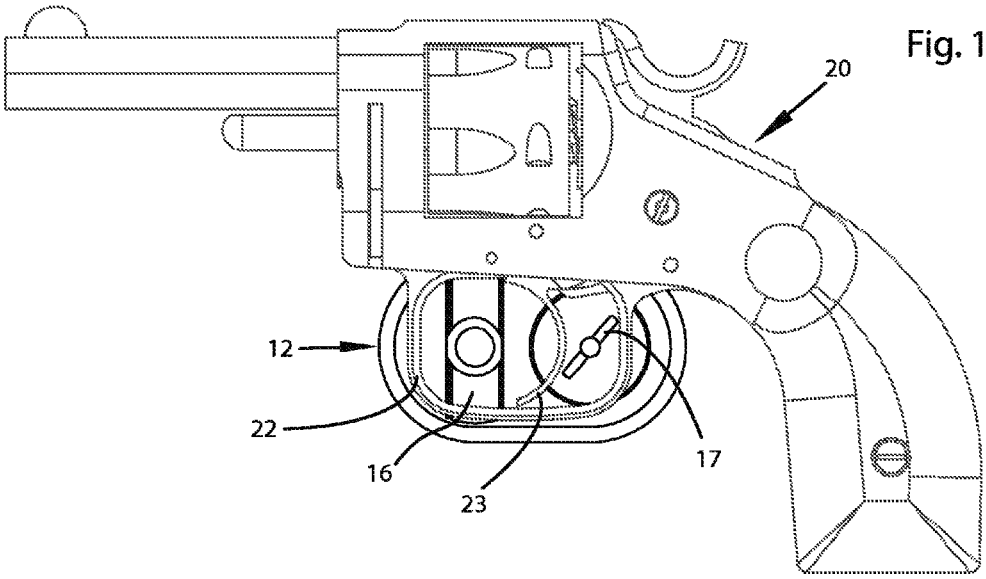
FIG. 10 is a side view of the main enclosure assembly installed on a firearm.
Figure 11:
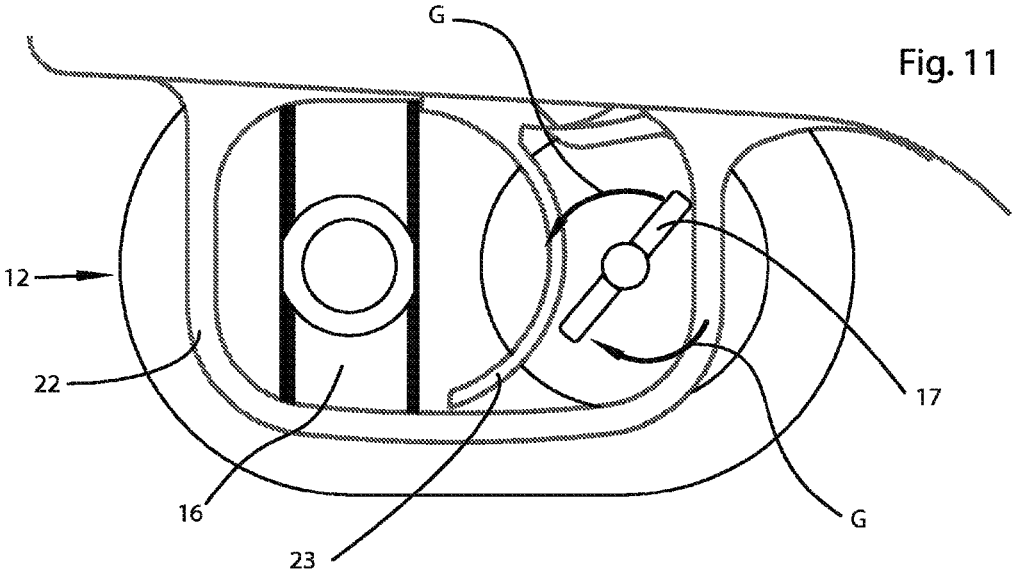
FIG. 11 is an enlarged detail view of FIG. 10, illustrating the taper probe and adjustable blocking cam.

Turning now to FIGS. 7, 10 and 11, trigger block 10 is intended to be installed on a firearm, preventing unauthorized use thereof. Tapered probe element 16 passes through trigger guard 22 forward of trigger 23. The taper of tapered probe element 16 accommodates different sizes of trigger guards. Tapered probe element 16 is inserted until it tightly engages the trigger guard in the vertical direction. This securely holds trigger block 10 in position on the firearm. Adjustable blocking cam 17 passes through trigger guard 22 rearward of trigger 23. Adjustable blocking cam 17 is then adjusted by rotation until one of flanges 44 engages the back of trigger 23 and the other engages trigger guard 22. Once this adjustment has been made, the screw is tightened, blocking cam 17 in position, requiring no further adjustment during future installation of block 10 on that specific firearm. The position of flanges 44 prevents rearward movement of trigger 23. In this manner, trigger 23 is blocked in position, unable to move forwardly or rearwardly.

Turning now to FIG. 12, illustrated is the organization of tamper notification system that operates on the control module 50. As described briefly earlier, elements of module 50 include a camera 55, which is preferably a single chip CCD camera, a battery 56 to power the various elements, and a magnetic reed switch 52 and switch magnet 75. If main enclosure assembly 12 is removed from slide assembly 14, taper probe element 16 is removed from channel 63 and reed switch 52 is no longer influenced by switch magnet 75 and changes between the open and closed positions. The switching of reed switch 52 provides a signal to controller unit 85 in control module 50. This signal can result in various responses, such as a signal that the block has been removed generated by motion sensor 71 in control module 50. The signal can be audio, visual, or a signal from a wireless device 82 such as a ZigBee wireless transceiver chip, blue tooth and the like. The System further includes an omni directional motion sensor 71 which will initiate a signal if the firearm is moved. Again, the signal can be audio, visual, and/or a wireless signal to a device such as a cell phone or other wireless device. These devices and signals are controlled by a controller unit 85.

In use, the trigger block 10 can be set to provide a signal when it is moved and/or the block is released. This can be accomplished by an application, such as on a smart phone in communication with tamper notification system through transceiver chip 82. Controller unit 85 can be programmed to set the motion sensor 71 and notify the smart phone if the firearm is moved. The controller unit 85 can also be set to send a signal, such as to a cell phone if block 10 is removed. Timers can also be provided to prevent false alarms, such as a tremor causing the motion sensor 71 to trigger. If the motion does not repeat within a certain time or if the motion does not continue for a predetermined length of time, a signal is not sent. There are a large variety of combinations that can be achieved by the use of a motion sensor 71 to detect movement of the firearm, and a magnetic switch 75 to detect removal of trigger block 10, each of which can be programmed into controller unit 85 through wireless communication devices or onboard control panel.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A trigger block and tamper notification system for use on a firearm, comprising:

a main enclosure assembly including an engagement element receivable through a trigger guard of a firearm from a first side and an adjustable blocking cam extending therefrom and positionable adjacent the trigger guard of the firearm from the first side and for receipt by the slide assembly on the opposing side, the adjustable blocking cam comprising a post extending from a base to a distal end, the distal end receivable within the socket; the base being rotatably carried by the main enclosure assembly with the post extending outwardly therefrom, parallel to the engagement element; and a pair of flanges extending longitudinally along the post from the base to a position spaced apart from the distal end, and extending outwardly from opposing sides of the post;

a slide assembly having a complemental element for releasably engaging the engagement element on an opposing side of the trigger guard;

a magnetic reed switch carried within the engagement element;

a switch magnet mounted in the slide assembly adjacent the complemental element so as to be in a position adjacent the magnetic reed switch when the slide assembly is engaged with the main enclosure assembly; and a control module having a signaling element, the signaling element activated when the switch magnet is moved from the position adjacent the reed switch.

2. A trigger block and tamper notification system for use on a firearm, comprising:

a main enclosure assembly including an engagement element receivable through a trigger guard of a firearm from a first side, wherein the engagement element includes a probe tapered from a proximal end to a distal end, and a plurality of parallel teeth formed on opposed flattened outer surfaces of the probe and extending transverse to a longitudinal axis of the probe;

a slide assembly having a complemental element for releasably engaging the engagement element on an opposing side of the trigger guard, wherein the slide assembly includes a housing and the complemental element of the slide assembly comprises:

a channel formed in the housing;

a pair of pawl elements mounted in the housing on opposing sides of the channel;

each pawl includes a latch end and a release end and each pawl is mounted on a pivot pin intermediate the latch end and the release end for pivotal movement between an engage position for engaging the parallel teeth of the probe in which the latch end extends into the channel and a release position in which the latch end is withdrawn from the channel; and biasing elements carried by the housing, biasing the pawl elements into the engage position;

a magnetic reed switch carried within the engagement element;

a switch magnet mounted in the slide assembly adjacent the complemental element so as to be in a position adjacent the magnetic reed switch when the slide assembly is engaged with the main enclosure assembly; and a control module having a signaling element, the signaling element activated when the switch magnet is moved from the position adjacent the reed switch.

3. A trigger block and tamper notification system for use on a firearm, comprising:

a main enclosure assembly including an engagement element receivable through a trigger guard of a firearm from a first side and an adjustable blocking cam extending therefrom and receivable adjacent the trigger guard of the firearm from the first side and for receipt by the slide assembly on the opposing side, the adjustable blocking cam comprising a post extending from a base to a distal end, the distal end receivable within a socket formed in the slide assembly;

the base being rotatably carried by the main enclosure assembly with the post extending outwardly therefrom, parallel to the engagement element; and a pair of flanges extending longitudinally along the post from the base to a position spaced apart from the distal end, and outwardly from opposing sides of the post;

a slide assembly having a complemental element for releasably engaging the engagement element on an opposing side of the trigger guard;

a magnetic reed switch carried within the engagement element;

a switch magnet mounted in the slide assembly adjacent the complemental element so as to be in a position adjacent the magnetic reed switch when the slide assembly is engaged with the main enclosure assembly;

a motion sensor carried by the main enclosure assembly;

a control module having a signaling element, the reed switch and the motion detector coupled to the control module, the signaling element activated when the switch magnet is moved from the position adjacent the reed switch and when the firearm is moved, generating a signal from the motion detector to the control module.

4. A trigger block and tamper notification system for use on a firearm, comprising:

a main enclosure assembly including an engagement element receivable through a trigger guard of a firearm from a first side, the engagement element including a probe extending from the main enclosure assembly and tapered from a proximal end to a distal end, and a plurality of parallel teeth formed on opposed flattened outer surfaces of the probe and extending transverse to a longitudinal axis of the probe;

a slide assembly having a complemental element for releasably engaging the engagement element on an opposing side of the trigger guard, the slide assembly including a housing and the complemental element of the slide assembly further comprising:

a channel formed in the housing;

a pair of pawl elements mounted in the housing on opposing sides of the channel;

each pawl includes a latch end and a release end and is mounted on a pivot pin intermediate the latch end and the release end for pivotal movement between an engage position for engaging the parallel teeth of the probe in which the latch end extends into the channel and a release position in which the latch end is withdrawn from the channel; and biasing elements carried by the housing, biasing the pawl elements into the engage position;

a magnetic reed switch carried within the engagement element;

a switch magnet mounted in the slide assembly adjacent the complemental element so as to be in a position adjacent the magnetic reed switch when the slide assembly is engaged with the main enclosure assembly; and a control module having a signaling element, the signaling element activated when the switch magnet is moved from the position adjacent the reed switch.

5. A trigger block and tamper notification system mounted on a firearm, comprising:

a firearm including a trigger and a trigger guard;

a main enclosure assembly including an engagement element received through the trigger guard forward of the trigger and extending from a first side of the trigger guard to an opposing second side, the engagement element includes a probe extending from the main enclosure assembly and tapered from a proximal end to a distal end, and a plurality of parallel teeth formed on opposed flattened outer surfaces of the probe and extending transverse to a longitudinal axis of the probe; and wherein the slide assembly includes a housing and the complemental element of the slide assembly comprises:

a channel formed in the housing;

a pair of pawl elements mounted in the housing on opposing sides of the channel;

each pawl includes a latch end and a release end and is mounted on a pivot pin intermediate the latch end and the release end for pivotal movement between an engage position for engaging the parallel teeth of the probe in which the latch end extends into the channel and a release position in which the latch end is withdrawn from the channel; and biasing elements carried by the housing, biasing the pawl elements into the engage position;

a slide assembly having a complemental element releasably engaging the engagement element on the second side of the trigger guard;

a magnetic reed switch carried within the engagement element;

a switch magnet mounted in the slide assembly adjacent the complemental element so as to be in a position adjacent the magnetic reed switch with the engagement element releasably engaged with the complemental element; and a control module having a signaling element, the signaling element activated when the switch magnet is moved from the position adjacent the reed switch.

* * * * *